United States Patent [19]

Mayo

[11] 4,096,599

[45] Jun. 27, 1978

[54] BRUSH RETENTION MEANS FOR FLOOR TREATING MACHINES

[75] Inventor: Haydn Frank Mayo, Hazlemere, England

[73] Assignee: R. G. Dixon & Company Limited, Wembley, England

[21] Appl. No.: 773,842

[22] Filed: Mar. 2, 1977

[30] Foreign Application Priority Data

Mar. 4, 1976 United Kingdom ..... 8743/76

[51] Int. Cl.[2] ..... A47L 11/162

[52] U.S. Cl. ..... 15/49 R; 51/177

[58] Field of Search ..... 15/28, 29, 49 R, 50 R, 15/52, 98, 385, 230; 51/170, 177 T

[56] References Cited

U.S. PATENT DOCUMENTS

| | | | |
|---|---|---|---|
| 2,870,468 | 1/1959 | Barel | 15/49 R |
| 3,212,117 | 10/1965 | Ernstberger et al. | 15/50 R |
| 3,469,272 | 9/1969 | Gaudry et al. | 15/50 R |

*Primary Examiner*—Edward L. Roberts

*Attorney, Agent, or Firm*—Michael J. Striker

[57] ABSTRACT

A floor treating machine of the rotary brush type in which the or each brush is provided with an upstanding boss slidably mounted in or on a brush retaining element, and spring clip means for preventing inadvertent removal of the brush from the brush retaining element.

4 Claims, 1 Drawing Figure

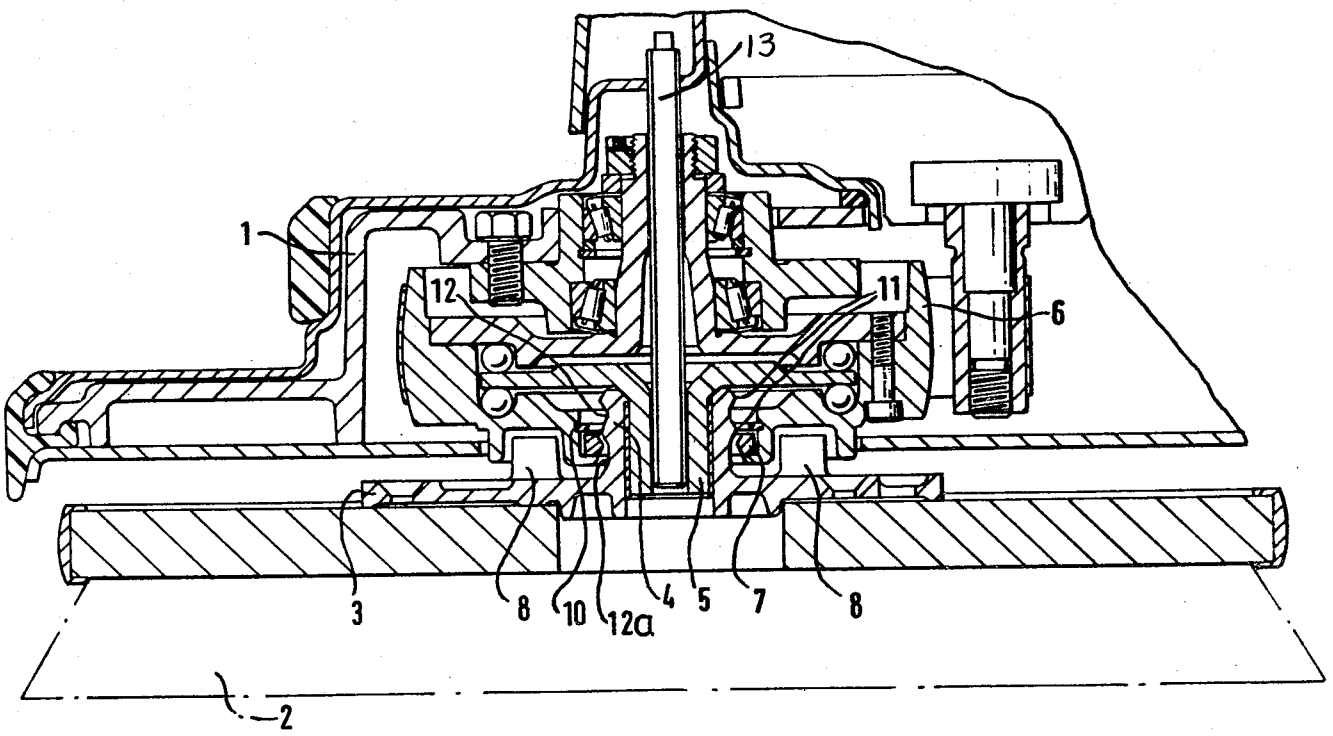
1
2
3
4
5
6
7
8
8
10
11
12
12a
13

BRUSH RETENTION MEANS FOR FLOOR TREATING MACHINES

This invention relates to floor treatment machines of the rotary brush type.

The expression "brush" as herein used should be deemed to include polishing or buffing pads in addition to scrubbing or polishing brushes.

The present invention consists in a floor treatment machine of the rotary brush type in which the or each brush is provided with an upstanding boss slidably mounted in or on a brush retaining element, and spring clip means for preventing inadvertent removal of the brush from the brush retaining means.

The spring clip means may be an annular spring clip mounted on a rotary part of the machine and cooperable with an annular lip formation, such as a rib on the boss.

Alternatively, the spring clip means may be an annular clip received in a recess on the boss and cooperable with a formation on a rotary part of the machine.

The invention will be further described with reference to the accompanying single FIGURE of drawing, which is a sectional view of part of a floor treatment machine showing a brush attached thereto according to one form of the invention.

The drawing shows part of a machine chassis 1 and the final drive mechanism 13 to a brush 2 having an adapter plate 3 screwed to the back thereof.

For a full description of the mechanism shown in the drawing, reference may be made to our copending application Ser. No. 773,843, filed Mar. 2, 1977 and entitled "Improvements in or relating to Floor Treatment Machines."

The plate 3 has an upstanding boss 4 received on a spigot 5 of a brush retaining member, and a pulley 6 has split spring ring 7 located by a circlip 10 and cooperating with ribs 11 defining a pair of recesses 12 and **12*a* in the outer face of the boss 4 to prevent inadvertent removal of the brush from the spigot 5**, e.g. when the machine is being manoeuvred on its transport wheels with the brush clear of the ground.

The relative diameters of the components are such that the split ring 7 has considerable "float" within the pulley 6, but is an interference fit with the outside diameter of the ribs 11.

When the brush backplate is pushed onto the spigot 5, the lower rib 11 forces the split ring 7 (which could be manufactured from any suitable spring material, metal or preferably plastic), open, so that split ring 7 enters recess **12*a* thus allowing full engagement of brush driving teeth or dogs 8 with co-operating recesses in the pulley 6**.

The split ring 7 prevents the brush 2 accidentally falling off when the machine is lifted or is in transit, but when in the recess 12 does allow the disengagement of the brush driving teeth or dogs 8 from their recesses. The reason for this is that the drive dogs are unidirectional and when the brush is rotated in a reverse direction relative to the pulley the slope on the back of the drive dogs causes it to disengage. The result is that when the machine is switched off with the brush off the ground the brush overruns the drive and the drive dogs are forced to disengage. This disengages the clip from the first recess **12*a* but allows the brush to be retained on the second recess 12** so that it does not fall off the machine.

Shaping of the split ring cross-section would be arranged to give appropriate "push-on" and "pull-off" forces.

The float of the split ring would provide for wide manufacturing tolerances and movement of the brush spigot within the pulley as required by the flexible nature of the brush coupling.

It will be appreciated that although the arrangement shown has the spring clip 7 mounted on the pulley 6, it may prove advantageous for the spring clip to be mounted on the boss 4 substantially in the position of the present lower rib 11, and a further formation, either a lip or an O ring to be mounted on the pulley 6.

It will also be appreciated that the boss 4 could in fact pass into a brush retaining member, so that its internal surface would be free and the retention could then be carried out by cooperation between the internal surface of the boss and an appropriate spigot within the brush retaining member.

Various other modifications may be made within the scope of the invention.

I claim:

1. In a floor treating machine of the type comprising at least one rotary brush alternately engaged with and disengaged from a brush drive, the improvement which comprises a brush retaining element; an upstanding boss on the at least one brush, said boss being slidably mounted on said brush retaining element and connected to the rotary brush; an annular lip formation on said boss and including integral ribs defining two recesses in said boss; and spring clip means mounted on a rotary part of the machine for cooperating with said annular lip formation, said spring clip means being an annular spring clip receivable in one of the recesses when the rotary brush is engaged with the brush drive and receivable in the other of said recesses when the rotary brush is disengaged from the brush drive.

2. A floor treating machine as claimed in claim 1, in which the spring clip is free to float but has its internal diameter as an interference fit with the lip formation.

3. A floor treating machine as claimed in claim 1, said recesses being superposed so as to form an upper recess and a lower recess in said boss, said spring clip being receivable in the upper recess to disengage the rotary brush from the brush drive and being receivable in the lower recess to engage the rotary brush with the brush drive.

4. A floor treating device as claimed in claim 1, said annular lip formation having two integral ribs on said boss.

* * * * *